US006004428A

United States Patent [19]

Schumacher et al.

[11] Patent Number: 6,004,428

[45] Date of Patent: Dec. 21, 1999

[54] PROCESS FOR FIBER RECOVERY FROM BONDED FIBER WEBS

[75] Inventors: Karl-Heinz Schumacher, Neustadt; Rainer Hummerich, Worms; Howard Peter Kirsch, Freinsheim, all of Germany

[73] Assignee: BASF Aktiengesellschaft, Ludwigshafen, Germany

[21] Appl. No.: 08/852,064

[22] Filed: May 6, 1997

[30] Foreign Application Priority Data

May 15, 1996 [DE] Germany ..... 196 19 639

[51] Int. Cl.[6] ..... B03B 1/04

[52] U.S. Cl. ..... 162/3; 162/5; 162/8; 162/70; 260/DIG. 31; 260/DIG. 43

[58] Field of Search ..... 162/4, 5, 8, 2, 162/3, 60, 72, 90, 70; 260/DIG. 31, DIG. 43; 156/344

[56] References Cited

U.S. PATENT DOCUMENTS

| | | | |
|---|---|---|---|
| 4,009,313 | 2/1977 | Crawford et al. | 260/DIG. 43 |
| 5,082,697 | 1/1992 | Patton et al. | 428/375 |
| 5,300,359 | 4/1994 | Matejcek et al. . | |
| 5,308,701 | 5/1994 | Cohen et al. | 428/402.22 |

FOREIGN PATENT DOCUMENTS

| | | |
|---|---|---|
| 2185161 | 3/1997 | Canada . |
| 0 442 370 | 8/1991 | European Pat. Off. . |
| 195 35 792 | 3/1997 | Germany . |
| 2 006 233 | 5/1979 | United Kingdom . |

*Primary Examiner*—Jan H. Silbaugh
*Assistant Examiner*—Kenneth M. Jones
*Attorney, Agent, or Firm*—Oblon, Spivak, McClelland, Maier & Neustadt, P.C.

[57] ABSTRACT

A process for dissolving a binder off a fiber web bonded therewith includes treating the fiber web, which is bonded with a polymeric binder having carboxylate groups crosslinked via alkaline earth metal cations, with an aqueous solution of an alkali metal salt to form a sparingly soluble salt or complex between the anion of the alkali metal salt and the alkaline earth metal cations, and then removing the fiber freed of the binder.

7 Claims, No Drawings

PROCESS FOR FIBER RECOVERY FROM BONDED FIBER WEBS

DESCRIPTION

The present invention relates to a process for recovering fiber from fiber webs. Fiber webs can be bonded by coating or impregnating with a binder.

There is a fundamental need for recyclable fiber webs where the fiber can be recovered after use. For this, the binder has to be dissolved off the bonded fiber web. Accordingly, JP 5 384 189 and unpublished German Patent Application P 19 535 792.3 (0050/46241) propose bonding fiber webs by means of uncrosslinked binders which become soluble in water on conversion of carboxyl groups into carboxylate groups and so can be separated back off the fibers.

Fiber webs with high strengths are obtained using binders which crosslink after application to the fiber web. To crosslink, the binders can contain monomers having a plurality of ethylenically unsaturated groups or monomers having other reactive groups, for example methylol groups. Crosslinking via metal salt groups, for example crosslinking via calcium carboxylate groups, is known from EP 442 370, for example. It is desired to recover fiber from fiber webs bonded with crosslinked binders, too.

It is an object of the present invention to provide a process for recovering fiber from fiber webs bonded with crosslinked binders.

We have found that this object is achieved by a process for dissolving a binder off a fiber web bonded therewith, which comprises treating the fiber web, which is bonded with a polymeric binder having carboxylate groups crosslinked via alkaline earth metal cations, with an aqueous solution of an alkali metal salt to form a sparingly soluble salt or complex between the anion of the alkali metal salt and the alkaline earth metal cations, and then removing the fiber freed of the binder.

Fiber webs for the process of this invention can be composed of a wide variety of fibers.

Examples of suitable fibers include synthetic fibers such as polyester, polyamide, polypropylene, polyacrylonitrile and carbon fibers and fibers of homo- and copolymers of vinyl chloride or tetrafluoroethylene, and also fibers of natural origin such as pulp, staple rayon, cellulose, cotton or wood fibers and also glass, ceramic and mineral fibers and mixtures thereof.

The fibers are laid to form webs and then bonded with a binder applied to the fibers in a conventional manner, for example by impregnating, spraying, knife-coating, dipping or printing. This is generally followed by drying to remove the solvent, generally water. In this conventional manner, a bonded fiber web is obtained.

The fiber webs thus produced find use for example as base materials for roofing membranes or floor coverings. The binders used are generally addition polymers of ethylenically unsaturated monomers.

The addition polymers contain carboxylate groups which are crosslinked via alkaline earth metal cations; that is, they are metal salt crosslinked.

The addition polymers preferably contain from 0.1 to 30% by weight, particularly preferably from 0.5 to 25% by weight, very particularly preferably from 5 to 20% by weight, of carboxylate groups, based on the polymer weight (weight of the alkaline earth metal cations not included).

The carboxylate groups are preferably present in a proportion of 50 to 100%, particularly preferably in a proportion of from 80 to 100%, as salt with alkaline earth metal cations.

Preferred alkaline earth metal cations are $Ca^{2+}$ and $Ba^{2+}$, $Mg^{2+}$. $Ca^{2+}$ is particularly preferred.

The metal salt crosslinked addition polymers are obtainable for example starting from addition polymers having carboxylic acid or carboxylic anhydride groups by addition of an alkaline earth metal salt, for example of an oxide, hydroxide, carbonate or bicarbonate, for example to the aqueous dispersion or solution of the polymer, as described in EP-A-442 370.

The metal salt crosslinked addition polymer is preferably constructed from the following monomers A), B) and C):

Monomers A)

Monomers A) are monomers having at least one carboxylic acid or carboxylic anhydride group which can be converted into a metal salt group. Suitable monomers include in particular acrylic acid, methacrylic acid, itaconic acid, maleic acid and maleic anhydride.

The amount of these monomers is defined by the desired content of alkaline earth metal cation crosslinked carboxylate groups.

Monomers B)

Of industrial significance are in particular so-called principal monomers B) selected from $C_1$–$C_{20}$-alkyl (meth) acrylates, vinyl esters of carboxylic acids containing up to 20 carbon atoms, aromatic vinyls containing up to 20 carbon atoms, ethylenically unsaturated nitriles, vinyl halides, vinyl ethers of alcohols containing from 1 to 10 carbon atoms, aliphatic hydrocarbons containing from 2 to 8 carbon atoms and 1 or 2 double bonds or mixtures thereof.

Examples of suitable monomers include $C_1$–$C_{10}$-alkyl (meth)acrylates, such as methyl methacrylate, methyl acrylate, n-butyl acrylate, ethyl acrylate and 2-ethylhexyl acrylate.

More particularly, mixtures of alkyl (meth)acrylates are also suitable.

Vinyl esters of carboxylic acids containing from 1 to 20 carbon atoms include for example vinyl laurate, vinyl stearate, vinyl propionate, vinyl Versatate and vinyl acetate.

Suitable aromatic vinyl compounds include vinyltoluene, α-methylstyrene, p-methylstyrene, α-butylstyrene, 4-n-butylstyrene, 4-n-decylstyrene and preferably styrene itself. Examples of nitriles are acrylonitrile and methacrylonitrile.

Vinyl halides are chlorine-, fluorine- or bromine-substituted ethylenically unsaturated compounds, preferably vinyl chloride and vinylidene chloride.

Suitable vinyl ethers including for example vinyl methyl ether and vinyl isobutyl ether. Preference is given to vinyl ethers of alcohols containing from 1 to 4 carbon atoms.

Examples of hydrocarbons containing from 2 to 8 carbon atoms and two olefinic double bonds are butadiene, isoprene and chloroprene.

Monomers C)

In addition to these principal monomers, the addition polymer may include further monomers C), for example hydroxyl-containing monomers, especially $C_1$–$C_{10}$-hydroxyalkyl (meth)acrylates or (meth)acrylamide.

Customary addition polymers are generally constructed from the above principal monomers B) to a proportion of at least 40, preferably at least 60, particularly preferably at least 80%, by weight.

The polymerization can be effected according to customary polymerization processes, for example by bulk, emulsion, suspension, dispersion, precipitation or solution polymerization. The polymerization processes mentioned are preferably carried out in the absence of oxygen, preferably in a stream of nitrogen. All of the polymerization methods are carried out using the customary apparatus, for example stirred tanks, stirred-tank cascades, autoclaves, tubular reactors and kneaders. Preference is given to using the method of solution, emulsion, precipitation or suspension polymerization. The methods of solution polymerization and especially emulsion polymerization are particularly preferred. The polymerization can be carried out in solvents or diluents, for example toluene, o-xylene, p-xylene, cumene, chlorobenzene, ethylbenzene, technical grade mixtures of alkylaromatics, cyclohexane, technical grade aliphatic mixtures, acetone, cyclohexanone, tetrahydrofuran, dioxane, glycols and glycol derivatives, polyalkylene glycols and derivatives thereof, diethyl ether, tert-butyl methyl ether, methyl acetate, isopropanol, ethanol, water or mixtures such as, for example, isopropanol-water mixtures. The preferred solvent or diluent is water with or without a proportion of up to 60% by weight of an alcohol or glycol. Particular preference is given to using water.

The metal crosslinked addition polymers are generally applied to the fiber webs in the form of their aqueous solution or dispersion. After drying, the fiber webs will be in a bonded state. The fiber webs then generally include from 1 to 40 parts by weight, preferably from 5 to 30 parts by weight, of the metal crosslinked binder, based on 100 parts by weight of fiber.

After the later use of the bonded fiber webs, the fiber can be recovered by the process of this invention by separating the binder from the fiber web, ie. from the fiber.

For this, the fiber web is treated with an aqueous solution of a salt (called "soluble salt" hereinafter) whose anion forms a sparingly water-soluble salt with the alkaline earth metal cation.

The soluble salt can be an inorganic or organic salt.

More particularly, it is an alkali metal salt.

The anion of the soluble salt can be for example oxalate or carbonate, which form a sparingly soluble salt with the calcium cation, for example.

The anion of the soluble salt can also be for example an organic anion which forms a sparingly soluble complex with the alkaline earth metal cation, for example $Ca^{2+}$. A suitable anion in this case is EDTA in particular.

The soluble salt present in the aqueous solution preferably has a solubility of at least 10 g/l of water at 23° C.

The aqueous solution preferably comprises the salt in amounts from 0.02 to 15 parts by weight, particularly preferably in amounts from 0.1 to 10 parts by weight, very particularly preferably from 0.5 to 2.5 parts by weight, based on 100 parts by weight of water.

By contrast, the solubility of the sparingly soluble alkaline earth metal salt formed in the course of the treatment of the fiber web is preferably less than 0.5 g/l of water at 23° C.

As well as the soluble salt, the aqueous solution preferably includes a phase transfer catalyst.

Suitable phase transfer catalysts are mentioned for example in Chimia 34 (1980) No. 1, 12–20. Examples of suitable phase transfer catalysts include polyalkylene glycols, commercially available as Pluriol®, for example, or quaternary, organic ammonium salts, commercially available as Lutensit, for example.

Suitable quaternary, organic ammonium salts include in particular those of the formula I

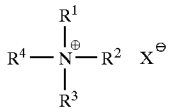

I where $R^1$–$R^4$ are each independently of the others an organic radical, preferably a hydrocarbon radical having from 1 to 12 carbon atoms, preferably from 1 to 6 carbon atoms, and $X^{\ominus}$ is an anion, preferably an inorganic anion, eg. $Cl^{\ominus}$, $Br^{\ominus}$.

Particularly preferred phase transfer catalysts are those having alkoxy groups, preferably having from 2 to 20 alkoxy groups, for example, alkylphenol ethoxylates (e.g. Lutensols® AP, Emulsifier 825 fatty alcohol ethoxylates (e.g. Lutensol A8) and oxo alcohol ethoxylates (e.g. Lutensol AO7, Lutensol ON80).

These phase transfer catalysts contain alkoxy groups as a result of alkoxylation of alkylphenols, fatty alcohols or oxo alcohols with alkylene oxides, preferably ethylene oxide.

The phase transfer catalyst content of the aqueous solution is preferably from 0.01 to 1 part by weight, particularly preferably from 0.08 to 0.5 part by weight, based on 100 parts by weight of water.

The aqueous solution may further comprise for example bases, especially sodium hydroxide solution, in order that the proportion of alkali metal cations may be raised.

The temperature of the aqueous solution can be for example from 10 to 100° C., particularly from 15 to 80° C., particularly preferably from 20 to 50° C. Temperatures above 30° C. are advantageous, above 40° C. more so, for even better and especially more rapid dissolution of binder off the fiber web.

The fiber web can be provided to the process of this invention intact or in comminuted form.

The fiber web is preferably comminuted into pieces having an edge length of from 1 to 10 cm.

To treat the fiber web with the aqueous solution, it is preferably placed in the aqueous solution. The amount of fiber web involved is preferably from 1 to 200 g, particularly preferably from 5 to 150 g very particularly preferably from 10 to 80 g, per liter of solution. The treatment time can be shortened by intensive stirring. In general, the time required will range from 5 minutes to 1 hour. Under strong stirring, however, less than 30 minutes, in particular less than 20 minutes, will be 5 sufficient to dissolve at least 80% by weight of the binder off the fiber and recover the fiber.

EXAMPLES

Polyester spun bonds from Hoechst, Bobingen, were impregnated with Acronal® DS 2324x (binder add-on of 20% by weight ±2 (solid/solid)). Acronal DS 2324X is an aqueous dispersion of a metal salt crosslinked addition polymer (crosslinking of the carboxylate groups of the polymer with $Ca^{2+}$ cations) based on acrylate. The drying took 5 min. at 200° C. in a Mathis laboratory dryer. The web sheets about DIN A-4 in size were then cut into pieces of about 1 $cm^2$.

Solutions in water were prepared of sodium oxalate, cold saturated to about 3% by weight, of sodium carbonate and of sodium ethylenediaminetetraacetate (Trilon B), the last two both to 10% strength by weight. 250 g of each of the resulting solutions were admixed with the amounts of phase transfer catalyst indicated in the table, with or without sodium hydroxide.

To recover the binder-free fiber from the fiber webs, pieces of the comminuted fiber web (see above) were placed in 250 g of the solution. The temperature of the solution and the amount of the fiber web are reported in the table.

The web pieces were left to stand for about 24 h and then stirred with a laboratory stirrer at 2000 rpm for 15 min.

The fiber was then collected on a 60$\mu$ sieve, dried at 130° C. for 2 h and weighed back.

The recyclability R reported in the table is calculated as follows:

$$R = \frac{\text{Fiber web before recycling in } g - \text{weighted back fiber in } g}{\text{Binder content of fiber web before recycling in } g} \cdot 100\%$$

Recyclability is 100% when the weighed back fibers are completely binder-free. The values in the table above 100% are explained by the fact that, when the fiber is collected, there may be very fine fiber which is not retained by the sieve, so that the weight of the fiber after recycling was too low.

| Per 250 g of solution | plus "solid" | plus solid 0.1 g | web starting weight based on solution [% by weight] | Recycling temperature [°C.] | Recyclability [%] |
|---|---|---|---|---|---|
| Sodium oxalate (saturated) | 1.25 g of Lutensol AP 10 (an alkylphenol ethoxylate) | — | 1 | RT* | 96 |
| Sodium carbonate, 10% strength | 5 g of benzyltrimethylammonium chloride | NaOH | 1 | RT | 42 |
| Trilon TB $Na_4$ (EDTA), 10% strength room temperature | 1.25 g of Emulsifier 825 (an alkylphenol ethoxylate) | — | 1 | RT | 111 |
| Trilon TB, 10% strength | 1,25 g of Lutensol A 8 (a fatty alcohol ethoxylate) | NaOH | 1 | RT | 112 |
| Sodium carbonate, 10% strength | 1.25 g of Lutensol AO 7 (an oxo alcohol ethoxylate) | — | 1 | RT | 75 |
| Sodium carbonate, 10% strength | 1.25 g of Lutensol ON 80 (an oxo alcohol ethoxylate) | NaOH | 1 | RT | 70 |
| Sodium carbonate, 10% | 1.25 g of Lutensol ON 80 | — | 1 | 50° C. | 101 |
| Trilon TB, 10% strength | | — | 1 | 50° C. | 27 |
| Sodium carbonate, 10% | 1,25 g of Lutensol A 8 | — | 4 | 50° C. | 100 |

*Room temperature

We claim:

1. A process for dissolving a binder off a fiber web bonded therewith, which comprises treating the fiber web, which is bonded with a polymeric binder having carboxylate groups crosslinked via alkaline earth metal cations, with an aqueous solution of an alkali metal salt to form a sparingly soluble salt or complex between the anion of the alkali metal salt and the alkaline earth metal cations wherein the sparingly soluble salt or complex has a solubility of less than 0.5 g/L, and then removing the fiber from the binder.

2. A process as claimed in claim 1, wherein the aqueous solution further comprises a phase transfer catalyst.

3. A process as claimed in claim 2, wherein the phase transfer catalyst is selected from the group consisting of the alkylphenol ethoxylates, fatty alcohol ethoxylates, oxo alcohol ethoxylates and quaternary organic ammonium salts.

4. A process as claimed in claim 1, wherein the alkaline earth metal cations are $Ca^{2+}$.

5. A process as claimed in claim 1, wherein the polymeric binder bonding the fiber web is a free-radically polymerized polymer having a carboxylate group content of from 0.1 to 30% by weight, based on the polymer, and from 50 to 100% by weight of the carboxylate groups are present as a salt with an alkaline earth metal cation.

6. A process as claimed in claim 1, wherein the aqueous solution of the alkali metal salt has a temperature of from 10 to 100° C.

7. A process as claimed in claim 1, wherein the fiber web is introduced into the aqueous solution of the alkali metal salt, the aqueous solution is stirred if necessary, and the fiber removed from the binder is separated off after from 1 to 60 minutes.

* * * * *